US008267450B2

(12) United States Patent
Aarhus et al.

(10) Patent No.: US 8,267,450 B2
(45) Date of Patent: Sep. 18, 2012

(54) ELEVATOR FOR GRIPPING AND LIFTING A RISER JOINT

(75) Inventors: Jon Olav Aarhus, Sauda (NO); Oystein Windsland, Sandnes (NO)

(73) Assignee: Vetco Gray Scandinavia AS, Sandvika (NO)

( * ) Notice: Subject to any disclaimer, the term of this patent is extended or adjusted under 35 U.S.C. 154(b) by 104 days.

(21) Appl. No.: 12/743,973

(22) PCT Filed: Nov. 21, 2008

(86) PCT No.: PCT/IB2008/003180

§ 371 (c)(1),
(2), (4) Date: May 20, 2010

(87) PCT Pub. No.: WO2009/066166

PCT Pub. Date: May 28, 2009

(65) Prior Publication Data

US 2010/0244476 A1 Sep. 30, 2010

(30) Foreign Application Priority Data

Nov. 21, 2007 (NO) ..... 20076008

(51) Int. Cl.
*E21B 19/06* (2006.01)

(52) U.S. Cl. ..... 294/194; 294/90; 294/907

(58) Field of Classification Search ..... 294/102.1, 294/102.2, 90, 91, 194, 907; 166/379
See application file for complete search history.

(56) References Cited

U.S. PATENT DOCUMENTS

| | | | | |
|---|---|---|---|---|
| 1,503,588 | A | | 8/1924 | Johnson |
| 2,245,938 | A | | 6/1941 | Ratigan |
| 2,636,769 | A | | 4/1953 | Cobb |
| 2,722,450 | A | * | 11/1955 | Nelson ..... 294/90 |
| 3,061,011 | A | | 10/1962 | Paget |
| 3,773,188 | A | | 11/1973 | Arrington |
| 4,441,749 | A | * | 4/1984 | Blaschke et al. ..... 294/194 |
| 4,647,099 | A | * | 3/1987 | Berry et al. ..... 294/103.1 |
| 4,649,777 | A | * | 3/1987 | Buck ..... 81/57.19 |
| 4,696,207 | A | | 9/1987 | Boyadjieff |
| 5,009,289 | A | * | 4/1991 | Nance ..... 188/67 |
| 5,340,182 | A | * | 8/1994 | Businck et al. ..... 294/199 |
| 5,609,457 | A | * | 3/1997 | Burns ..... 414/22.51 |

(Continued)

OTHER PUBLICATIONS

PCT/ISA/210—International Search Report—Mar. 19, 2009.

(Continued)

*Primary Examiner* — Dean Kramer
(74) *Attorney, Agent, or Firm* — Venable LLP

(57) ABSTRACT

An elevator for gripping and lifting a riser joint or several interconnected riser joints of a completion and work over riser. A body includes a through bore for receiving a production pipe of a riser joint. The through bore is accessible via a longitudinal opening in the body. The body includes at least one locking device including a hydraulic cylinder. A piston rod of the hydraulic cylinder is moveable to and fro between an unlocking position, in which the piston rod allows a production pipe of a riser joint to pass into or out of the through bore via the longitudinal opening, and a locking position, in which the piston rod prevents a production pipe received in the through bore from passing out of the through bore via the longitudinal opening.

11 Claims, 3 Drawing Sheets

U.S. PATENT DOCUMENTS

| | | | | |
|---|---|---|---|---|
| 6,082,225 | A * | 7/2000 | Richardson | 81/57.16 |
| 6,138,529 | A * | 10/2000 | Pietras | 81/57.33 |
| 7,188,548 | B2 * | 3/2007 | Liess | 81/57.24 |
| 2002/0153169 | A1 | 10/2002 | Sewell | |
| 2008/0174131 | A1 * | 7/2008 | Bouligny et al. | 294/88 |

OTHER PUBLICATIONS

PCT/ISA/237—Written Opinion of the International Searching Authority—Mar. 19, 2009.
Norwegian Search Report—Apr. 23, 2008.

* cited by examiner

ELEVATOR FOR GRIPPING AND LIFTING A RISER JOINT

CROSS-REFERENCE TO RELATED APPLICATIONS

This application claims priority to Norwegian patent application 20076008 filed 21 Nov. 2007 and is the national phase under 35 U.S.C. §371 of PCT/IB2008/003180 filed 21 Nov. 2008.

FIELD OF THE INVENTION AND PRIOR ART

The present invention relates to an elevator for gripping and lifting a riser joint or several interconnected riser joints of a completion and work over riser.

A completion and work over riser may be of the monobore type or the dual bore type. A dual bore riser comprises a production pipe and an annulus pipe extending in parallel with the production pipe. The production pipe is designed for taking a load and has strength for lifting, whereas the annulus pipe is just a pressure containing pipe with no strength for lifting. Thus, a dual bore riser may only be lifted through the production pipe and no lifting force may be exerted on the annulus pipe. A monobore riser comprises a production pipe but no annulus pipe.

A completion and work over riser is used in the oil and gas industry when oil and/or gas is to be extracted from one or more offshore wells. Completion and work over operations are performed on a subsea wellhead using a completion and work over riser. A completion and work over riser may for instance be used for installing or retrieving a so-called X-mas tree. It may also be used for installing or pulling a so-called tubing hanger. With a dual bore riser it will be possible to circulate a fluid down through the production pipe and up through the annulus pipe or vice versa. Such fluid circulation is used to clean a well and to test and verify a circulation path. The bore of the production pipe and the bore of the annulus pipe of a dual bore riser may be connected to two corresponding bores in an X-mas tree so that a wire line or coiled tubing can be used to access plugs or other devices installed in the bores of the X-mas tree. The bore of the production pipe of a riser may also be connected to the production tubing that extends from a tubing hanger all the way to the bottom of a well. Installing the tubing and tubing hanger is referred to as completing a well and is consequently a completion operation. When a well is completed, it is made ready for production of oil and/or gas or alternatively for injection of $CO_2$ or water. If the well does not produce as expected, it may be overhauled or repaired in different ways. This is referred to as work over.

U.S. Pat. No. 3,061,011 A discloses an elevator for lifting a drill string formed of interconnected drill pipe sections (see FIGS. 7-9 in U.S. Pat. No. 3,061,011 A).

U.S. Pat. No. 4,696,207 A discloses another type of elevator for lifting a drill string formed of interconnected drill pipe sections (see FIGS. 18 and 19 in U.S. Pat. No. 4,696,207 A). This elevator comprises a body which is adapted to extend entirely about a pipe section of a drill string.

SUMMARY OF THE INVENTION

The object of the present invention is to make possible a safe and efficient handling of a riser joint or several interconnected riser joints of a completion and work over riser, for instance when lifting a riser string consisting of several interconnected riser joints in connection with completion and work over operations or during operations involving lifting and positioning of a riser joint in connection with the assembling or disassembling of a riser string consisting of several interconnected riser joints.

According to the invention, this object is achieved by an elevator.

The inventive elevator comprises a body provided with a through bore for receiving a production pipe of a riser joint, the through bore being accessible via a longitudinal opening in the body extending all along the through bore in the axial direction thereof so as to allow a production pipe of a riser joint to be received in the through bore via the longitudinal opening by moving the body over said production pipe in the radial direction thereof. The body of the elevator is provided with a shoulder for supporting a collar of a production pipe received in the through bore so as to thereby allow the riser joint to be lifted by means of the elevator. The body of the elevator is also provided with at least one locking device in the form of a hydraulic cylinder, the piston rod of which being moveable to and fro between an unlocking position, in which the piston rod allows a production pipe of a riser joint to pass into or out of the through bore of the body via the longitudinal opening, and a locking position, in which the piston rod prevents a production pipe received in the through bore of the body from passing out of the through bore via the longitudinal opening.

Thus, the elevator according to the present invention may be connected to a riser joint by moving the body of the elevator across the riser joint in such a manner that the production pipe of the riser joint is received in the through bore of the body via the longitudinal opening of the through bore. The respective locking device is then actuatable in such a manner that its piston rod will be moved from the unlocking position to the locking position so as to thereby secure the elevator to the riser joint and allow the riser joint to be lifted by the elevator in a safe manner. During this lifting operation, the piston rod of the respective locking device will prevent a production pipe received in the through bore from falling out of the through bore via the longitudinal opening of the through bore. The elevator makes it possible to grip and lift a monobore or dual bore riser joint of a completion and work over riser in an automated manner without requiring any manual labour, which reduces the risk of personal injuries and reduces the time required to run a completion and work over riser string. The longitudinal opening in the elevator's body and the design of the locking device will make it possible to grip a production pipe of a dual bore riser joint and to lift such a riser joint through the production pipe without engaging with the annulus pipe of the riser joint.

According to an embodiment of the invention, the respective locking device has the form of a fail safe hydraulic cylinder, the piston rod of which being retained in its prevailing position in the event of hydraulic failure. Hereby, a production pipe gripped by the elevator is prevented from falling out of the through bore of the elevator's body in a situation when the supply of hydraulic fluid to the respective locking device is interrupted due to a hydraulic failure.

According to another embodiment of the invention, the body of the elevator is provided with at least two locking devices of the above-mentioned type, each of which being capable on its own of preventing a production pipe received in the through bore of the body from passing out of the through bore via the longitudinal opening thereof. This will increase the safety.

Further advantages as well as advantageous features of the elevator of the present invention will appear from the following description.

BRIEF DESCRIPTION OF THE DRAWINGS

With reference to the appended drawings, a specific description of preferred embodiments of the invention cited as examples follows below. In the drawings.

DETAILED DESCRIPTION OF PREFERRED EMBODIMENTS OF THE INVENTION

Figure 1:
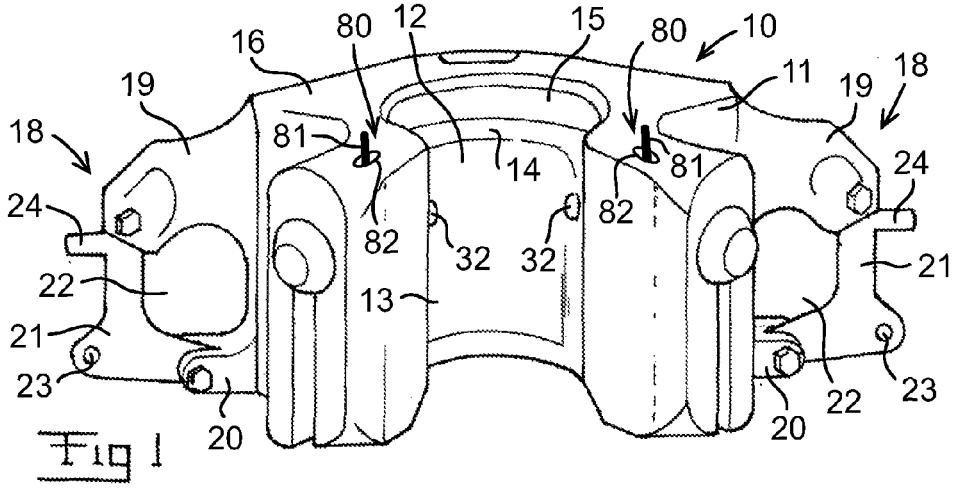
FIG. 1 is a perspective view of an elevator according to an embodiment of the present invention.
Figure 2:
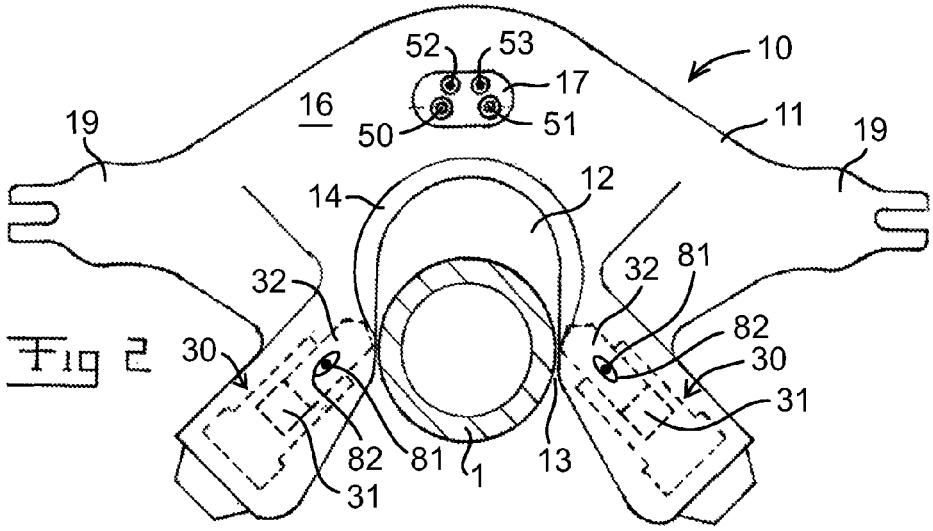
FIG. 2 is a planar view from above of the elevator of FIG. 1, with a production pipe of a riser joint to be gripped by the elevator shown in cross-section.
Figure 3:
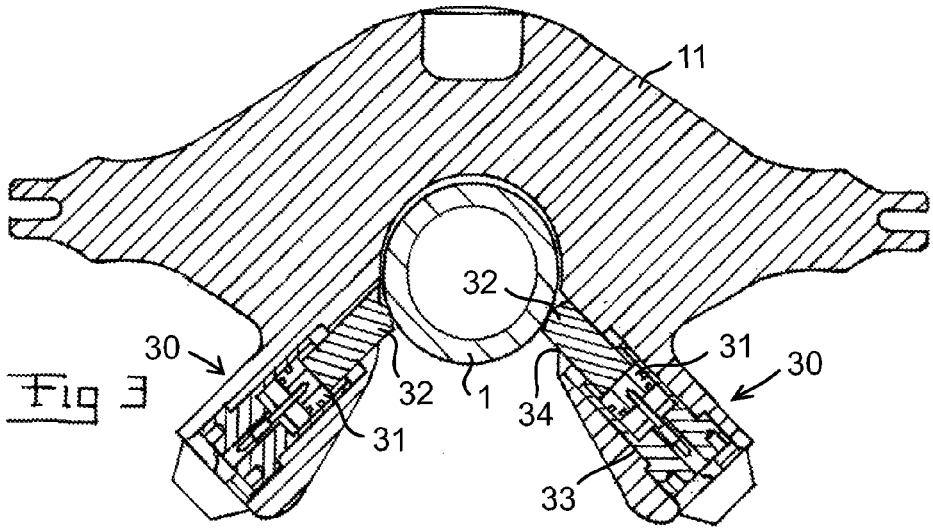
FIG. 3 is a cross-sectional view of the elevator of FIG. 1 and a production pipe of a riser joint gripped by the elevator.

An elevator 10 according to an embodiment of the present invention is illustrated in FIGS. 1-3. The elevator 10 may be used for gripping and lifting a riser joint of a completion and work over riser during operations involving lifting and positioning of the riser joint in connection with the assembling or disassembling of a riser string consisting of several interconnected riser joints. The elevator 10 may also be used for gripping and lifting a completion and work over riser consisting of several interconnected riser joints, for instance in connection with completion and work over operations.

The elevator 10 comprises a body 11 provided with a through bore 12 for receiving a production pipe 1 of a riser joint. The through bore 12 is accessible via a longitudinal opening 13 in the body 11 extending all along the through bore 12 in the axial direction thereof. The longitudinal opening 13 is so designed that a production pipe 1 of a riser joint is insertable into the through bore 12 via the longitudinal opening 13 by moving the body 11 over said production pipe in the radial direction of the production pipe 1, as illustrated in FIGS. 2 and 3. Thus, a production pipe 1 of a riser joint is receivable in the through bore 12 of the body 11 by positioning the body 11 at the side of a riser joint with the longitudinal opening 13 of the through bore facing the production pipe 1 of the riser joint, and then moving the body 11 onto the production pipe 1.

The body 11 is provided with a shoulder 14 for supporting a collar 2 (see FIGS. 5 and 6) arranged at one end of a production pipe 1 of a riser joint 4. The shoulder 14 is arranged in the through bore 12 or at one of the ends thereof so as to allow the shoulder 14 to be displaced into contact with said collar 2 when the body 11, in the axial direction of the through bore 12, is moved in relation to a production pipe received in the through bore towards the collar 2 of the production pipe. When the elevator 10 is lifting a riser joint, the collar 2 of the production pipe 1 of the riser joint rests against the shoulder 14 and the body 11 is consequently supporting the riser joint via this shoulder 14. In the illustrated example, the shoulder 14 is formed by a widened end section 15 of the through bore 12, which widened end section 15 forms a descended seat designed for receiving said collar 2 and retaining the collar in radial direction, as illustrated in FIG. 6.

The collar 2 of the production pipe 1 may be an integrated part of the production pipe or alternatively a nut, a so-called Jam Nut, which is secured to the production pipe by screwing.

The body 11 is provided with at least one locking device 30 in the form of a hydraulic cylinder, which comprises a displaceable piston 31 and a piston rod 32 secured to the piston. The piston rod 32 is moveable to and fro between a retracted unlocking position (see FIG. 2), in which the piston rod 32 allows a production pipe 1 of a riser joint to pass into or out of the through bore 12 via the longitudinal opening 13, and an advanced locking position (see FIG. 3), in which the piston rod 32 prevents said production pipe of the riser joint from passing out of the through bore 12 via the longitudinal opening 13 when positioned in the through bore. In the illustrated example, the body 11 is provided with two such locking devices 30 arranged at opposite sides of the longitudinal opening 13 of the through bore 12. These two locking devices 30 are arranged to provide redundancy in that each one of them is capable on its own of preventing a production pipe of a riser joint received in the through bore 12 of the body 11 from passing out of the through bore via the longitudinal opening 13.

The respective locking device 30 is mounted in a cavity 33 in the body 11 and its piston rod 32 extends through an opening 34 in the cavity facing the through bore 12 of the body.

The respective locking device 30 suitably has the form of a fail safe hydraulic cylinder, the piston rod 32 of which being retained in its prevailing position in the event of hydraulic failure. Thus, if the supply of hydraulic fluid to the hydraulic cylinder of the locking device 30 is interrupted when its piston rod 32 is in the advanced locking position, the pressure on the piston side of the hydraulic cylinder will be maintained and the piston rod will thereby remain in its advanced locking position. Hereby, an unintended movement of the piston rod 32 of the locking device from the advanced locking position to the retracted unlocking position due to lack of hydraulic supply pressure is prevented.

The elevator 10 is suitably provided with a detector 40 (see FIG. 4) so as to make it possible to verify that the piston rods 32 of the locking devices 30 have reached the advanced locking position. In the example illustrated in FIG. 4, the detector 40 comprises two hydraulic valves 41, 42, each of which being associated with its own locking device 30 and being changed from a closed state to an open state when the piston rod 32 of the associated locking device reaches its locking position and from an open state to a closed state when the piston rod 32 of the associated locking device leaves its locking position. The hydraulic valves 41, 42 are connected in series in such a manner that a hydraulic connection between two ends 43, 44 of a hydraulic line 45 associated with the hydraulic valves 41, 42 is established only when the hydraulic valves 41, 42 are both in the open state, i.e. when the piston rods 32 of both locking devices 30 are in the advanced locking position. Such a hydraulic connection will consequently indicate that the piston rods 32 of both locking devices 30 are in the advanced locking position.

In the embodiment illustrated in FIGS. 1 and 2, each locking device 30 is also associated with a mechanical detector 80 for detecting that the piston rod 32 of the locking device 30 has reached its locking position. The mechanical detector 80 comprises a visual indicating member 81, which is moved from a first position to a second position under the influence of the piston rod 32 when the piston rod is moved from its unlocking position to its locking position and back from the second position to the first position when the piston rod 32 is moved from its locking position to its unlocking position. In the illustrated example, the indicating member 81 is elongated and mounted so as to extend in the radial direction of the piston rod 32 through a slot 82 provided in the upper surface 16 of the body 11. The indicating member 81 may be fixed to the piston rod 32 so as to move together with the piston rod in the longitudinal direction of the slot 82. The upper part of the indicating member 81, which extends beyond the upper surface 16 of the body 11, is suitably flexible, whereas the lower part of the indicating member 81, which is located below the upper surface 16 of the body 11, is rigid and may be formed by a rigid pin.

The hydraulic detector 40 and the mechanical detectors 80 provide redundancy with respect to the indication that the respective piston rod 32 is in the locking position.

Figure 4:
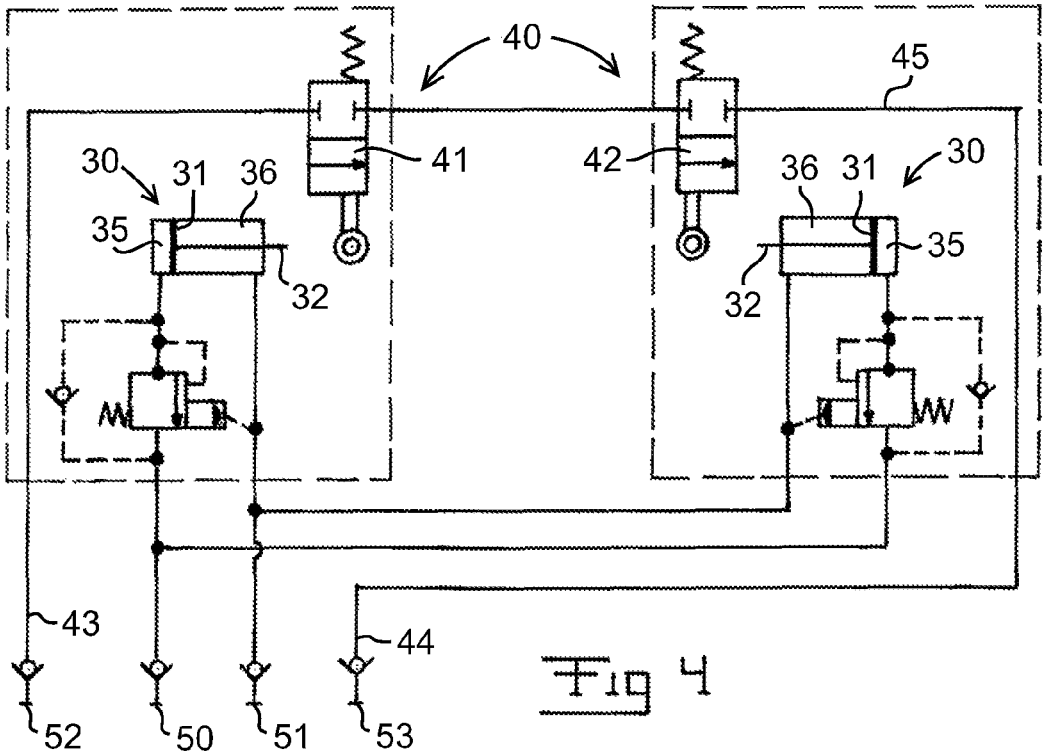
FIG. 4 is a hydraulic flow diagram for the elevator of FIG. 1.

The body 11 is provided with hydraulic connectors 50-53 (see FIG. 2) for connection of the hydraulic cylinders of the locking devices 30 and the hydraulic valves 41, 42 of the detector 40 to an external hydraulic control system. The connectors 50-53 are preferably of quick coupling type. In the illustrated example, the connectors 50-53 are arranged in a pocket 17 provided in the upper surface 16 of the body 11. The piston side 35 of the hydraulic cylinders of the two locking devices 30 are with advantage jointly connected to a first hydraulic connector 50, as illustrated in FIG. 4, whereas the piston rod side 36 of the hydraulic cylinders of the two locking devices 30 are jointly connected to a second hydraulic connector 51. In order to move the piston rods 32 of the locking devices 30 forward from the unlocking position to the locking position, hydraulic pressure is supplied to said first connector 50 and return taken from said second connector 51. In order to retract the piston rods 32 of the locking devices 30 from the locking position to the unlocking position, hydraulic pressure is supplied to said second connector 51 and return taken from said first connector 50. The above-mentioned two ends 43, 44 of the hydraulic line 45 of the detector 40 are connected to a respective one of the other two connectors 52, 53.

In the illustrated example, the body 11 is provided with two ear-like attachments 18 arranged at opposite sides of the body, each of which being designed for engagement with a rod 61 of an elevating device 60 (see FIG. 5) so as to allow the elevator 10 to be operatively attached to said elevating device. Each attachment 18 comprises an upper part 19 and a lower part 20 formed as projections on the body 11. A link 21 is releasably secured between said upper and lower parts 19, 20 of the attachment 18. Each rod 61 is provided with a bail 62 at its lower end. When the rods 61 are mounted to the elevator 10, each bail 62 is received in the open space 22 between the upper and lower parts 19, 20 of the associated attachment 18 of the body 11 with the upper part 19 of the attachment extending through the central opening of the bail. The link 21 retains the bail 62 in said space 22. Thus, the body 11 is supported by the rods 61 via the upper parts 19 of the attachments 18.

The elevating device 60 comprises a top drive 63, to which the rods 61 are connected at their upper ends and which controls the movement of the rods. A part of the top drive 63 is very schematically illustrated in FIG. 5.

Each attachment 18 is suitably designed for engagement with a rotary assembly 64 mounted to the associated rod 61 of the elevating device so as to allow the body 11 of the elevator 10 to be tilted in relation to the rods 61 by means of the rotary assemblies 64. The respective rotary assembly 64 comprises a base part 66, which is secured to the associated rod 61. The base part 66 carries a driving device 67, for instance formed by two hydraulic cylinders. The rotary assembly 64 further comprises a rotary part 68, which is rotatably mounted to the base part 66 and rotatable in relation to the base part by means of the driving device 67. The respective attachment 18 is secured to the rotary part 68 of the associated rotary assembly 64 by means of a bolt 65 (see FIG. 6) extending through a bolthole 23 (see FIG. 1) provided in the link 21 of the attachment, and by means of a locking pin (not shown) inserted through a vertical hole provided in a protrusion arranged in the upper part of the link 21.

The body 11 is suitably designed and balanced in such a manner that the elevator 10 can be operated to grip and lift a vertically extending riser joint as well as a horizontally extending riser joint without requiring any rotary assemblies of the above-mentioned type.

Figure 5:
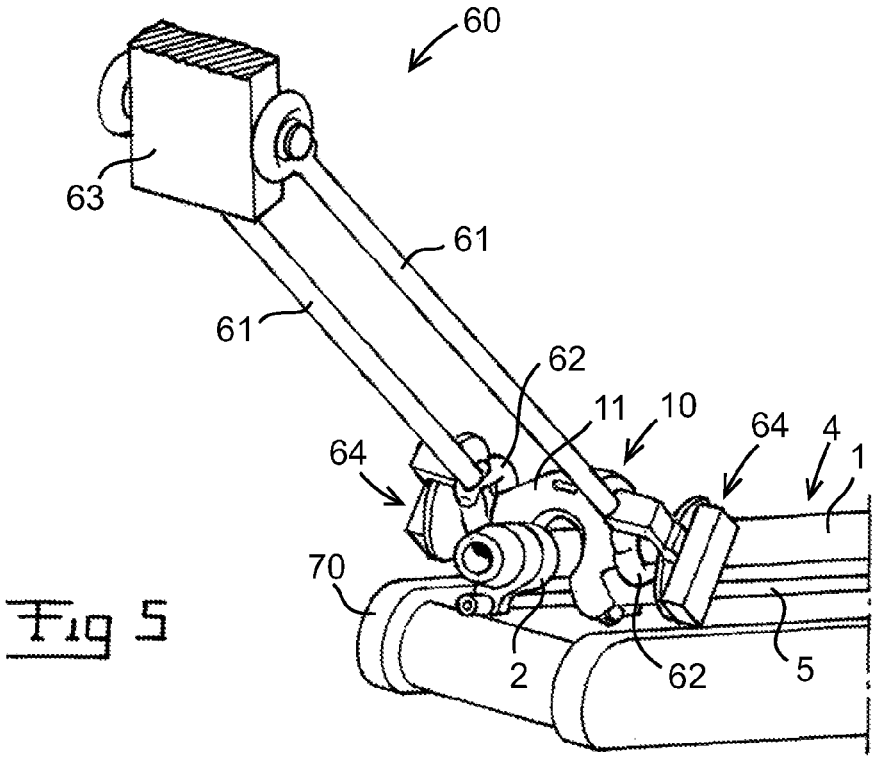
FIG. 5 is a perspective view illustrating a step in the process of gripping a dual bore riser joint by means of the elevator of FIG. 1.
Figure 6:
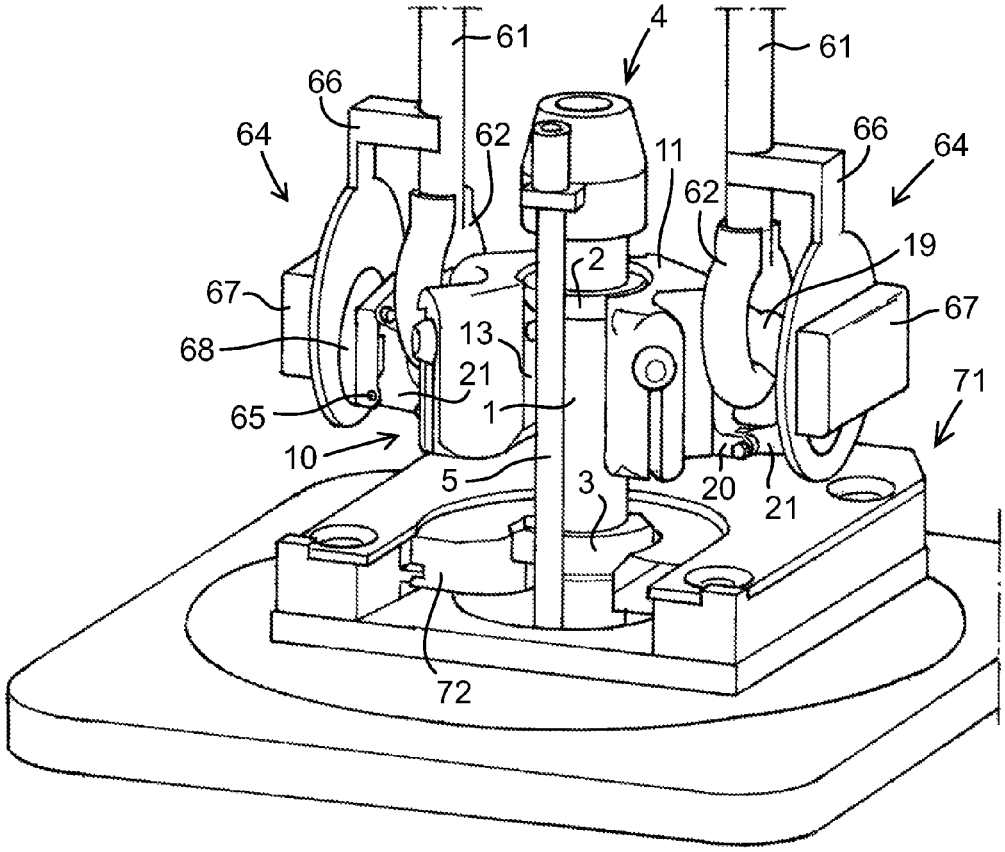
FIG. 6 is a perspective view illustrating a step in the process of handling a dual bore riser joint by means of the elevator of FIG. 1.

The elevator 10 may for instance be used for lifting a dual bore riser joint 4 from a horizontal catwalk 70 or shuttle, as illustrated in FIG. 5, or from an inclined or vertical chute. By means of the top drive 63 and the rotary assemblies 64, the body 11 of the elevator 10 is positioned next to the production pipe 1 of the riser joint 4 behind a collar 2 thereof (the so-called elevator ring) with the longitudinal opening 13 of the body's through bore 12 facing the production pipe 1. The body 11 is then moved into engagement with the production pipe 1 with the piston rods 32 of the locking devices 30 in the retracted unlocking position so as to allow the body 11 to embrace the production pipe 1 at a position behind the collar 2, as illustrated in FIG. 5. Hereby, the production pipe 1 is received in the through bore 12 of the body 11, whereas the annulus pipe 5 of the riser joint 4 is located outside the through bore 12. The body 11 is then displaced in the axial direction of the production pipe 1 until the shoulder 14 of the body comes into engagement with the collar 2 of the production pipe, whereupon the piston rods 32 of the locking devices 30 are moved from the retracted unlocking position to the advanced locking position so as to lock the body 11 to the production pipe 1 and prevent the production pipe from falling out of the through bore 12 of the body 11 via the longitudinal opening 13 when the body is lifted by means of the top drive 63. The top drive 63 is then operated to lift the riser joint 4 so that it leaves the catwalk 70 and becomes completely suspended by the body 11 of the elevator through the production pipe 1. The riser joint 4 may now be lowered down into engagement with and secured to another riser joint supported in a vertical direction by a so-called spider 71. The top drive 63 is then operated to lift the assembled string of riser joints supported by the support plate 72 of the spider 71 a short distance upwards and the support plate is retracted, whereupon the top drive 63 is operated to lower the assembled string of riser joints downwards until the landing block 3 provided on the uppermost riser joint 4 is in level with the support plate 72. The support plate 72 is then advanced to the position illustrated in FIG. 6, whereupon the top drive 63 is operated to lower the assembled string of riser joints further downwards until the landing block 3 of the uppermost riser joint 4 comes to rest on the support plate 72. When the landing block 3 of the riser joint 4 has come to rest on the support plate 72, the piston rods 32 of the locking devices 30 are retracted to the unlocking position, whereupon the body 11 of the elevator can be lowered so as to allow the collar 2 to come free from the shoulder 14. The body 11 can then be released from the riser joint 4 and moved back to the catwalk 70 in order to pick up a new riser joint from the catwalk.

The elevator 10 may grip a production pipe 1 of a riser joint 4 from above, as illustrated in FIG. 5, when the riser joint is laying on a catwalk or chute with the annulus pipe 5 facing the catwalk or chute. However, if the riser joint 4 is laying on a catwalk or chute with the production pipe 1 facing the catwalk or chute and extending somewhat beyond the end thereof, the elevator 10 may grip the production pipe 1 from below.

When a completion and work over riser is to be disassembled, the elevator 10 is used in the reversed order for gripping an uppermost riser joint 4 of an assembled string of riser joints supported by the support plate 72 of the spider 71, and lifting the string of assembled riser joints upwards so as to allow the landing block of the next riser joint of the string to come to rest on the support plate 72 of the spider. The uppermost riser joint 4 is then released from the string and lifted with the aid of the elevator 10 onto the catwalk 70.

When a riser joint 4 is hanging vertically from the body 11 of the elevator, the production pipe 1 of the riser joint is kept securely in place in the through bore 12 of the body 11 by the shoulder 14, which in this situation is retaining the collar 2 of the production pipe 1 in the vertical direction as well as the radial direction. The purpose of the locking devices 30 is to prevent the production pipe 1 from falling out of the through bore 12 of the elevator's body 11 in case the collar 2 of the production pipe 1 would come free from the shoulder 14, which may happen during pick up and lay down of the riser joint 4.

The invention is of course not in any way restricted to the embodiments described above. On the contrary, many possibilities to modifications thereof will be apparent to a person with ordinary skill in the art without departing from the basic idea of the invention such as defined in the appended claims.

The invention claimed is:

1. An elevator for gripping and lifting a riser joint or several interconnected riser joints of a completion and work over riser, the elevator comprising:

a body comprising a through bore for receiving a production pipe of a riser joint, the through bore being accessible via a longitudinal opening in the body extending all along the through bore in the axial direction thereof so as to allow a production pipe of a riser joint to be received in the through bore via the longitudinal opening by moving the body over said production pipe in the radial direction thereof, the body further comprising a shoulder for supporting a collar of a production pipe received in the through bore so as to thereby allow the riser joint to be lifted by the elevator, the body further comprising at least one locking device in the form of a hydraulic cylinder, a piston rod of which is moveable to and fro between an unlocking position, in which the piston rod allows a production pipe of a riser joint to pass into or out of the through bore via the longitudinal opening, and a locking position, in which the piston rod prevents a production pipe received in the through bore from passing out of the through bore via the longitudinal opening;

at least one detector for detecting that the piston rod of the locking device has reached the locking position; and a mechanical detector for detecting that the piston rod of the locking device has reached the locking position, the mechanical detector comprising a visual indicating member which is moved under the influence of the piston rod from a first position to a second position when the piston rod is moved from the unlocking position to the locking position and from the second position to the first position when the piston rod is moved from the locking position to the unlocking position.

2. The elevator according to claim 1, wherein the shoulder is arranged in the through bore or at one of the ends thereof so as to allow the shoulder to be displaced into contact with the collar of a production pipe when the body, in the axial direction of the through bore, is moved in relation to a production pipe received in the through bore towards the collar of the production pipe.

3. The elevator according to claim 2, wherein the shoulder is formed by a widened end section of the through bore, which widened end section forms a seat designed for receiving said collar and retaining the collar in radial direction.

4. The elevator according to claim 1, wherein the locking device has the form of a fail safe hydraulic cylinder, the piston rod of which being retained in a prevailing position in the event of hydraulic failure.

5. The elevator according to claim 1, further comprising:

a detector comprising a hydraulic switch for detecting that the piston rod of the locking device has reached the locking position.

6. The elevator according to claim 1, wherein the body comprises at least two locking devices, which are arranged to provide redundancy in that each one of the locking devices is arranged to be capable of preventing a production pipe received in the through bore of the body from passing out of the through bore via the longitudinal opening.

7. The elevator according to claim 6, wherein the body comprises two locking devices arranged at opposite sides of the longitudinal opening.

8. The elevator according to claim 6, further comprising:

a detector for detecting that the piston rods of all locking devices have reached the locking position.

9. The elevator according to claim 8, wherein the detector comprises a number of hydraulic valves connected in series, each of which being associated with an own locking device and being changed from a closed state to an open state when the piston rod of the associated locking device reaches the locking position and from an open state to a closed state when the piston of the associated locking device leaves the locking position.

10. The elevator according to claim 1, wherein the body comprises two attachments arranged at opposite sides of the body, each attachment being designed for engagement with a rod of an elevating device so as to allow the elevator to be operatively attached to said elevating device.

11. The elevator according to claim 10, wherein at least one of said attachments is designed for engagement with a rotary assembly mounted to the rod of an elevating device so as to allow the elevator to be tilted by said rotary assembly when attached to said elevating device.

* * * * *